US011600920B2

(12) United States Patent
Udagave

(10) Patent No.: US 11,600,920 B2
(45) Date of Patent: Mar. 7, 2023

(54) REMOTE ELECTRONIC TILT ACTUATORS FOR CONTROLLING MULTIPLE PHASE SHIFTERS AND BASE STATION ANTENNAS WITH REMOTE ELECTRONIC TILT ACTUATORS

(71) Applicant: CommScope Technologies LLC, Hickory, NC (US)

(72) Inventor: Shital Sawanta Udagave, Maharashtra (IN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/766,632

(22) PCT Filed: Nov. 11, 2020

(86) PCT No.: PCT/US2020/059926
§ 371 (c)(1),
(2) Date: Apr. 5, 2022

(87) PCT Pub. No.: WO2021/118740
PCT Pub. Date: Jun. 17, 2021

(65) Prior Publication Data
US 2022/0384948 A1 Dec. 1, 2022

Related U.S. Application Data

(60) Provisional application No. 62/947,610, filed on Dec. 13, 2019.

(51) Int. Cl.
*H01Q 3/32* (2006.01)
*H01Q 3/36* (2006.01)
(Continued)

(52) U.S. Cl.
CPC ..... *H01Q 3/36* (2013.01); *H01P 1/184* (2013.01); *H01Q 1/246* (2013.01); *H01Q 3/32* (2013.01); *H01Q 21/08* (2013.01)

(58) Field of Classification Search
CPC ..... H01Q 1/246; H01Q 3/30; H01Q 3/32; H01Q 3/36; H01P 1/184
See application file for complete search history.

(56) References Cited

U.S. PATENT DOCUMENTS 7,907,096 B2 3/2011 Timofeev et al.
8,217,848 B2 7/2012 Girard et al.
(Continued)

FOREIGN PATENT DOCUMENTS

CN 209730178 U 12/2019
KR 101600832 B1 3/2016
(Continued)

OTHER PUBLICATIONS

"International Search Report and Written Opinion of the International Searching Authority", International Application No. PCT/US2020/059921, dated Mar. 3, 2021, 10 pp.
(Continued)

*Primary Examiner* — Hasan Islam
(74) *Attorney, Agent, or Firm* — Myers Bigel, P.A.

(57) ABSTRACT

A first mechanical linkage is connected between a RET actuator and a first phase shifter. A second mechanical linkage is connected between the RET actuator and a second phase shifter. The RET actuator includes a rotary drive element operably coupled to at least one drive gear for moving the at least one drive gear in a first rotary direction and a second rotary direction. A first drive system is connected to the first mechanical linkage and a second drive system is connected to the second mechanical linkage. The first drive system has a first driven gear and the second drive
(Continued)

system has a second driven gear where the first driven gear and the second driven gear are coaxially located relative to one another. An index system selectively couples the at least a one drive gear to one of the first driven gear and the second driven gear.

26 Claims, 8 Drawing Sheets

(51) Int. Cl.

| | |
|---|---|
| ***H01P 1/18*** | (2006.01) |
| ***H01Q 1/24*** | (2006.01) |
| ***H01Q 21/08*** | (2006.01) |

(56) References Cited

U.S. PATENT DOCUMENTS

| | | | | |
|---|---|---|---|---|
| 9,343,811 | B2 | 5/2016 | Xie et al. | |
| 10,320,076 | B2 * | 6/2019 | Fang | F16H 1/32 |
| 10,490,894 | B2 * | 11/2019 | Kim | H01Q 1/125 |
| 10,734,712 | B2 * | 8/2020 | Duan | H01Q 1/246 |
| 2006/0066494 | A1 | 3/2006 | Trejtnar et al. | |
| 2013/0307728 | A1 | 11/2013 | Berger et al. | |
| 2017/0365923 | A1 | 12/2017 | Schmutzler et al. | |
| 2018/0287255 | A1 | 10/2018 | Zimmerman | |
| 2020/0373663 | A1 | 11/2020 | Xu | |

FOREIGN PATENT DOCUMENTS

| | | | |
|---|---|---|---|
| KR | 101804955 | B1 | 12/2017 |
| WO | 2017196811 | A1 | 11/2017 |

OTHER PUBLICATIONS

"International Search Report and Written Opinion of the International Searching Authority", International Application No. PCT/US2020/059926, dated Mar. 8, 2021, 11 pp.

* cited by examiner

REMOTE ELECTRONIC TILT ACTUATORS FOR CONTROLLING MULTIPLE PHASE SHIFTERS AND BASE STATION ANTENNAS WITH REMOTE ELECTRONIC TILT ACTUATORS

CROSS-REFERENCE TO RELATED APPLICATIONS

The present application is a 35 U.S.C. § 371 national stage application of PCT Application No. PCT/US2020/059926, filed on Nov. 11, 2020, which itself claims priority from and the benefit of U.S. Provisional Patent Application No. 62/947,610, filed Dec. 13, 2019, the entire contents of both of which are incorporated herein by reference in their entireties. The above-referenced PCT Application was published in the English language as International Publication No. WO 2021/118740 A1 on Jun. 17, 2021.

FIELD OF THE INVENTION

The present invention relates to communication systems and, in particular, to base station antennas having remote electronic tilt capabilities.

BACKGROUND

Cellular communications systems are used to provide wireless communications to fixed and mobile subscribers (herein "users"). A cellular communications system may include a plurality of base stations that each provide wireless cellular service for a specified coverage area that is typically referred to as a "cell." Each base station may include one or more base station antennas that are used to transmit radio frequency ("RF") signals to, and receive RF signals from, the users that are within the cell served by the base station. Base station antennas are directional devices that can concentrate the RF energy that is transmitted in certain directions (or received from those directions). The "gain" of a base station antenna in a given direction is a measure of the ability of the antenna to concentrate the RF energy in that particular direction. The "radiation pattern" of a base station antenna is compilation of the gain of the antenna across all different directions. The radiation pattern of a base station antenna is typically designed to service a pre-defined coverage area such as the cell or a portion thereof that is typically referred to as a "sector." The base station antenna may be designed to have minimum gain levels throughout its pre-defined coverage area, and it is typically desirable that the base station antenna have much lower gain levels outside of the coverage area to reduce interference between sectors/cells. Early base station antennas typically had a fixed radiation pattern, meaning that once a base station antenna was installed, its radiation pattern could not be changed unless a technician physically reconfigured the antenna. Unfortunately, such manual reconfiguration of base station antennas after deployment, which could become necessary due to changed environmental conditions or the installation of additional base stations, was typically difficult, expensive and time-consuming.

More recently, base station antennas have been deployed that have radiation patterns that can be reconfigured from a remote location by transmitting control signals to the antenna. Base station antennas having such capabilities are typically referred to as remote electronic tilt ("RET") antennas. The most common changes to the radiation pattern are changes in the down tilt angle (i.e., the elevation angle) and/or the azimuth angle. RET antennas allow wireless network operators to remotely adjust the radiation pattern of the antenna by transmitting control signals to the antenna that electronically alter the RF signals that are transmitted and received by the antenna.

Base station antennas typically comprise a linear array or a two-dimensional array of radiating elements such as patch, dipole or crossed dipole radiating elements. In order to electronically change the down tilt angle of these antennas, a phase taper may be applied across the radiating elements of the array, as is well understood by those of skill in the art. Such a phase taper may be applied by adjusting the settings on an adjustable phase shifter that is positioned along the RF transmission path between a radio and the individual radiating elements of the base station antenna. One widely-used type of phase shifter is an electromechanical "wiper" phase shifter that includes a main printed circuit board and a "wiper" printed circuit board that may be rotated above the main printed circuit board. Such wiper phase shifters typically divide an input RF signal that is received at the main printed circuit board into a plurality of sub-components, and then capacitively couple at least some of these sub-components to the wiper printed circuit board. The sub-components of the RF signal may be capacitively coupled from the wiper printed circuit board back to the main printed circuit board along a plurality of arc-shaped traces, where each arc has a different diameter. Each end of each arc-shaped trace may be connected to a radiating element or to a sub-group of radiating elements. By physically (mechanically) rotating the wiper printed circuit board above the main printed circuit board, the locations where the sub-components of the RF signal capacitively couple back to the main printed circuit board may be changed, which thus changes the length of the respective transmission path from the phase shifter to an associated radiating element for each sub-component of the RF signal. The changes in these path lengths result in changes in the phases of the respective sub-components of the RF signal, and since the arcs have different radii, the phase changes along the different paths will be different. Thus, the above-described wiper phase shifters may be used to apply a phase taper to the sub-components of an RF signal that are applied to each radiating element (or sub-group of radiating elements). Exemplary phase shifters of this variety are discussed in U.S. Pat. No. 7,907,096 to Timofeev, the disclosure of which is hereby incorporated by reference herein in its entirety. The wiper printed circuit board is typically moved using an electromechanical actuator such as a DC motor that is connected to the wiper printed circuit board via a mechanical linkage. These actuators are often referred to as RET actuators since they are used to apply the remote electronic down tilt.

SUMMARY OF THE INVENTION

In some embodiments, a base station antenna, comprises a remote electronic tilt ("RET") actuator. A first mechanical linkage is connected between the RET actuator and a first phase shifter, and a second mechanical linkage is connected between the RET actuator and a second phase shifter. The RET actuator comprises a rotary drive element operably coupled to at least one drive gear for moving the at least one drive gear in a first rotary direction and a second rotary direction. A first drive system is connected to the first mechanical linkage where the first drive system comprises a first driven gear. A second drive system is connected to the second mechanical linkage where the second drive system comprises a second driven gear. The first driven gear and the second driven gear are coaxially located relative to one another. An index system selectively couples the at least one drive gear to one of the first driven gear and the second driven gear.

The rotary drive element may comprise a motor having a rotary output. The at least one drive gear may comprise a first drive gear and a second drive gear. The index system may selectively couple the first drive gear to the first driven gear and the second drive gear to the second driven gear. The at least one drive gear may be mounted on an output shaft of the rotary drive element. The first drive gear and the second drive gear may be mounted on an output shaft of the rotary drive element. The index system may comprise a second drive element. The second drive element may move an index gear. The index gear may comprise a cam surface. The second drive element may move a cam surface. The index gear may rotate. The index gear may comprise a gear that engages a mating gear of the second drive element such that actuation of the second drive element rotates the index gear. The index system may comprise a cam wheel rotated by the second drive element. The second drive element may be rotary. The cam surface may comprise a first cam profile and a second cam profile that is different than the first cam profile. The first cam profile may be positioned to contact the first driven gear. The first driven gear may be biased into engagement with the first cam profile. The first driven gear may be biased into engagement with the cam surface by a spring. The profile may be configured to move the first driven gear to an engaged position with the first drive gear. The second cam profile may be configured to move the second driven gear to an engaged position with the second drive gear. A linkage may operatively connect the second cam profile to the second driven gear. The first cam profile may be out of phase with the second cam profile. The first cam profile and the second cam profile may be configured such that when the first driven gear is engaged with the first drive gear, the second driven gear is disengaged from the second drive gear and when the first driven gear is disengaged from the first drive gear, the second driven gear is engaged with the second drive gear. The first cam profile and the second cam profile may be configured such that both the first driven gear and the second driven gear may be disengaged from the first drive gear and the second drive gear simultaneously. The first driven gear may be operatively coupled to a first linear drive and the second driven gear may be operatively coupled to a second linear drive. The first linear drive and the second linear drive may each comprise a respective rotary drive member. The first linear drive may comprise a first lead screw. The second linear drive may comprise a second lead screw. The first lead screw may have a first axis of rotation and the second lead screw may have a second axis of rotation where the first axis of rotation and the second axis of rotation may be coaxial. The first lead screw may be positioned inside of the second lead screw. The first driven gear may be mounted for translational motion relative to the first lead screw along the first axis of rotation. A stub may be connected to the first lead screw that is slidably received in an aperture formed in the first driven gear. A sliding connector may connect the stub to the first driven gear. A first follower may be threadably mounted on the first lead screw. A first connector tube may connect the first follower to the first mechanical linkage. The first follower may be connected to the first mechanical linkage. The second driven gear may be mounted for translational motion relative to the second lead screw along the second axis of rotation. The second driven gear may comprise a tubular barrel that is mounted on a tubular extension of the second lead screw. A sliding connector may connect the tubular extension to the second driven gear. A second follower may be threadably mounted on the second lead screw. A second connector tube may connect the second follower to the second mechanical linkage. The second follower may be connected to the second mechanical linkage.

In some embodiments, a method of operating a base station antenna comprising a remote electronic tilt ("RET") actuator, a first mechanical linkage connected between the RET actuator and a first phase shifter, and a second mechanical linkage connected between the RET actuator and a second phase shifter is provided. The method comprises providing a first drive system connected to the first mechanical linkage, the first drive system comprising a first driven gear, and a second drive system connected to the second mechanical linkage the second drive system comprising a second driven gear, wherein the first driven gear and the second driven gear are coaxially located relative to one another; coupling a drive gear to a selected one of the first driven gear and the second driven gear; rotating the drive gear to move the selected one of the first driven gear and the second driven gear in a first rotary direction and a second rotary direction.

In some embodiments, a RET actuator comprises a rotary drive element operably coupled to at least one drive gear for moving the at least one drive gear in a first rotary direction and a second rotary direction. A first drive system is connected to the first mechanical linkage where the first drive system comprises a first driven gear. A second drive system is connected to the second mechanical linkage where the second drive system comprises a second driven gear. The first driven gear and the second driven gear are coaxially located relative to one another. An index system selectively couples the at least one drive gear to one of the first driven gear and the second driven gear.

In some embodiments, a base station antenna comprises a remote electronic tilt ("RET") actuator. A first mechanical linkage is connected between the RET actuator and a first phase shifter, and a second mechanical linkage is connected between the RET actuator and a second phase shifter. The RET actuator comprises a rotary drive element operably coupled to at least one drive gear for moving the at least one drive gear in a first rotary direction and a second rotary direction. A first drive system is connected to the first mechanical linkage where the first drive system comprises a first driven gear and a first rotary drive member. A second drive system is connected to the second mechanical linkage where the second drive system comprises a second driven gear and a second rotary drive member. The first rotary drive member is located inside the second rotary drive member. An index system selectively couples the at least one drive gear to one of the first driven gear and the second driven gear.

DETAILED DESCRIPTION

Modern base station antennas often include two, three or more arrays of radiating elements. If the arrays include cross-polarized radiating elements, then a separate phase shifter is provided for each polarization (i.e., two phase shifters per linear array). Moreover, separate transmit and receive phase shifters are often provided for each array so that the transmit and receive radiation patterns may be independently adjusted, which may again double the number of phase shifters. Additionally, in some cases, some (or all) of the arrays may be formed using wideband radiating elements that support service in multiple frequency bands (e.g., the 700 MHz and 800 MHz frequency bands or two or more frequency bands within the 1.7-2.7 GHz frequency range). When such wideband arrays are used, separate phase shifters may be provided for each frequency band within the broader operating frequency range of the radiating elements. Since base station antennas with two to as many as eight arrays of cross-polarized radiating elements are being deployed, it is not uncommon for a base station antenna to have eight, twelve or even twenty-four adjustable phase shifters for applying remote electronic down tilts to the arrays. As described above, RET actuators are provided in the antenna that are used to move elements on the phase shifters to adjust the down tilt angle of the antenna beams formed by the various arrays. While the same down tilt is typically applied to the phase shifters for the two different polarizations, allowing a single RET actuator and a single mechanical linkage to be used to adjust the phase shifters for both polarizations, modern base station antennas still often need four, six, twelve or even more RET actuators.

As more complex base station antennas are introduced, requiring ever increasing numbers of independently controlled phase shifters, it can become difficult to design base station antennas that fit within customer-demanded limitations on the size of the antenna. Pursuant to embodiments of the present invention, base station antennas are provided that include RET actuators that are less expensive to manufacture and may have a smaller physical footprint. The base station antennas pursuant to some embodiments of the present invention may include, among other things, a RET actuator, a plurality of phase shifters and a plurality of mechanical linkages, where each mechanical linkage is connected between the RET actuator and a respective one of the phase shifters.

Figure 1A:
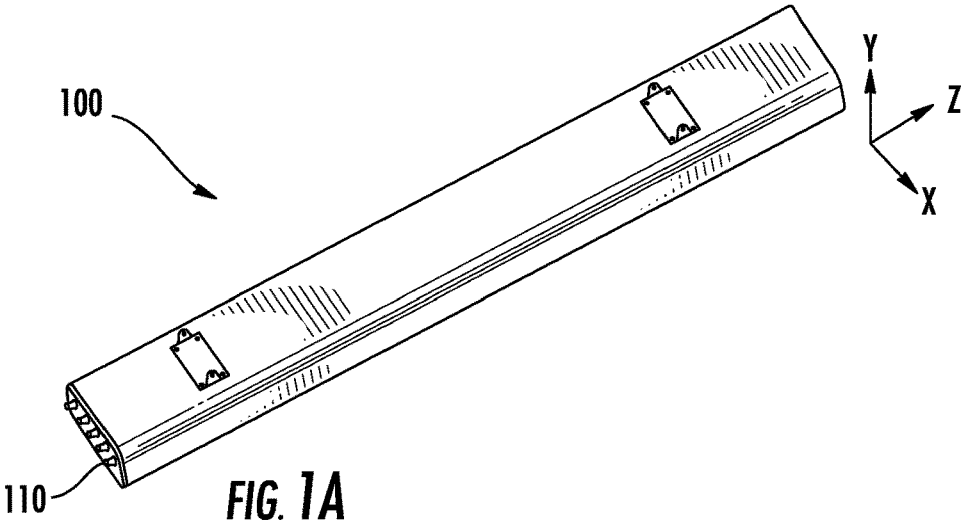
FIG. 1A is a perspective view of an example base station antenna according to embodiments of the present invention.
Figure 1B:
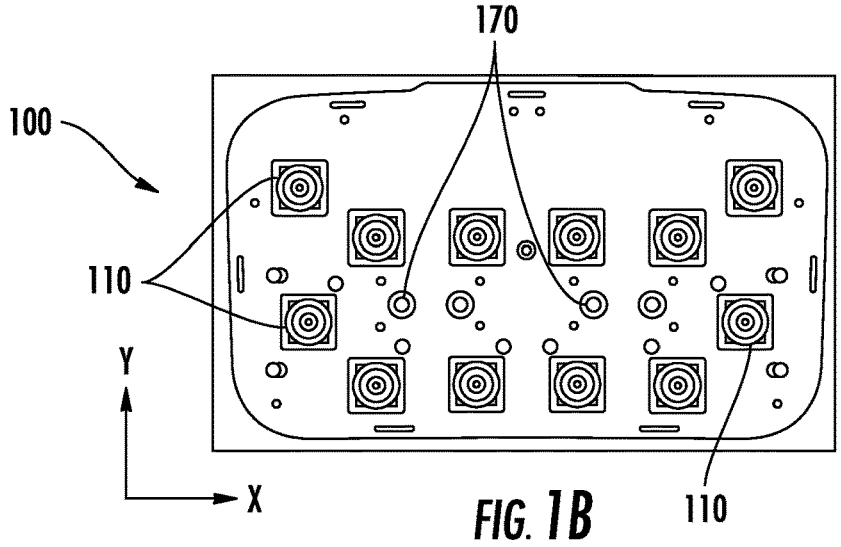
FIG. 1B is an end view of the base station antenna of FIG. 1A.
Figure 1C:
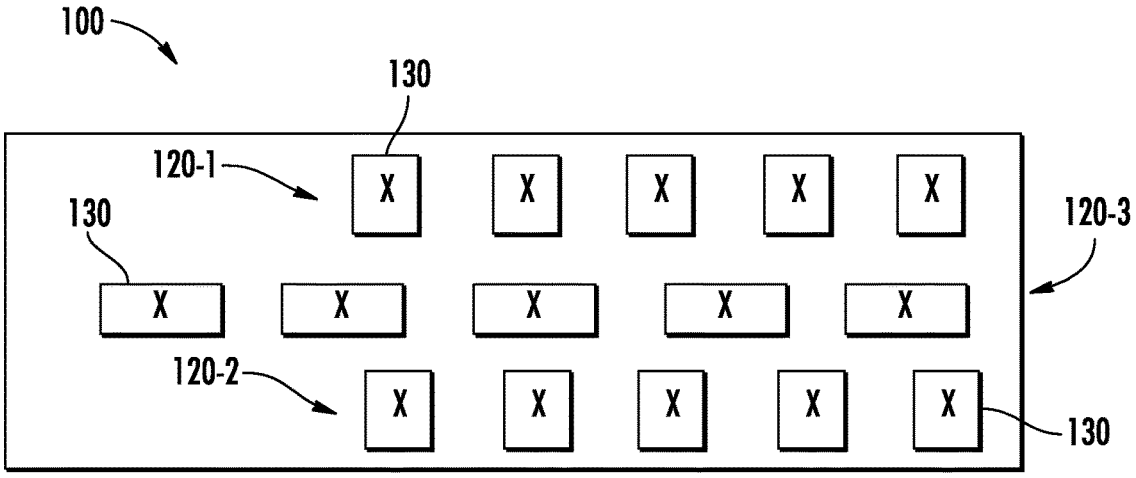
FIG. 1C is a schematic plan view of the base station antenna of FIG. 1A that illustrates three linear arrays of radiating elements thereof.
Figure 2:
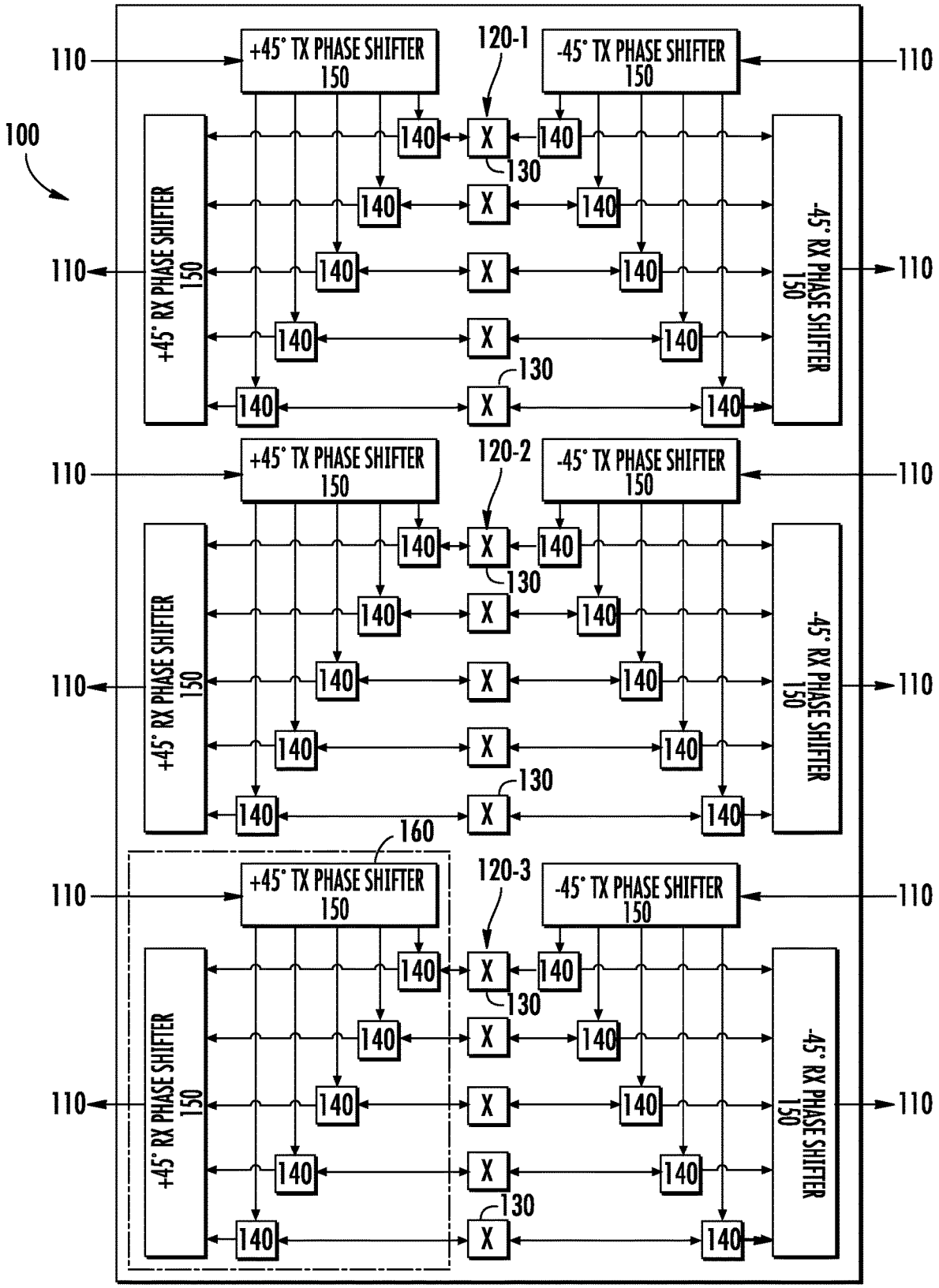
FIG. 2 is a schematic block diagram illustrating the electrical connections between various components of the base station antenna of FIGS. 1A-1C.

Embodiments of the present invention will now be discussed in greater detail with reference to the drawings. FIG. 1A is a perspective view of a base station antenna 100 that may include one or more of the RET actuators according to embodiments of the present invention. FIG. 1B is an end view of the base station antenna 100 (with the radome thereof removed) that illustrates the input/output ports thereof. FIG. 1C is a schematic plan view of the base station antenna 100 that illustrates three arrays of radiating elements thereof. FIG. 2 is a schematic block diagram illustrating various components of the base station antenna 100 and the electrical connections therebetween. It should be noted that FIG. 2 does not show the actual location of the various elements on the antenna, but instead is drawn to merely show the electrical transmission paths between the various elements.

Referring to FIGS. 1A-1C and 2, the base station antenna 100 includes, among other things, input/output ports 110, a plurality of arrays 120 of radiating elements 130, duplexers 140, phase shifters 150 and control ports 160. As shown in FIGS. 1C and 2, the base station antenna 100 may include a total of three arrays 120 (labeled 120-1 through 120-3) that each include five radiating elements 130. It will be appreciated, however, that the number of arrays 120 and the number of radiating elements 130 included in each of the arrays 120 may be varied. It will also be appreciated that different arrays 120 may have different numbers of radiating elements 130.

Referring to FIG. 2, the connections between the input/output ports 110, radiating elements 130, duplexers 140 and phase shifters 150 are schematically illustrated. Each set of an input port 110 and a corresponding output port 110, and their associated phase shifters 150 and duplexers 140, may comprise a corporate feed network. A dashed box is used in FIG. 2 to illustrate one of the six corporate feed networks included in antenna 100. Each corporate feed network connects the radiating elements 130 of one of the linear arrays 120 to a respective pair of input/output ports 110.

As shown schematically in FIG. 2 by the "X" that is included in each box, the radiating elements 130 may be cross-polarized radiating elements 130 such as +45°/−45° slant dipoles that may transmit and receive RF signals at two orthogonal polarizations. Any other appropriate radiating element 130 may be used including, for example, single dipole radiating elements or patch radiating elements (including cross-polarized patch radiating elements). When cross-polarized radiating elements 130 are used, two corporate feed networks may be provided per linear array 120, a first of which carries RF signals having the first polarization (e.g., +45°) between the radiating elements 130 and a first pair of input/output ports 110 and the second of which carries RF signals having the second polarization (e.g., −45°) between the radiating elements 130 and a second pair of input/output ports 110, as shown in FIG. 2.

As shown in FIG. 2, an input of each transmit ("TX") phase shifter 150 may be connected to a respective one of the input ports 110. Each input port 110 may be connected to the transmit port of a radio (not shown) such as a remote radio head. Each transmit phase shifter 150 has five outputs that are connected to respective ones of the radiating elements 130 through respective duplexers 140. The transmit phase shifters 150 may divide an RF signal that is input thereto into a plurality of sub-components and may effect a phase taper to the sub-components of the RF signal that are provided to the radiating elements 130. In a typical implementation, a linear phase taper may be applied to the radiating elements 130. As an example, the sub-components of the RF signal fed to the first radiating element 130 in a linear array 120 may have a phase of Y°+2X°, the sub-components of the RF signal fed to the second radiating element 130 in the linear array 120 may have a phase of Y°+X°, the sub-components of the RF signal fed to the third radiating element 130 in the linear array 120 may have a phase of Y°, the sub-components of the RF signal fed to the fourth radiating element 130 in the linear array 120 may have a phase of Y°−X°, and the sub-components of the RF signal fed to the fifth radiating element 130 in the linear array 120 may have a phase of Y°−2X°, where the radiating elements 130 are arranged in numerical order.

Similarly, each receive ("RX") phase shifter 150 may have five inputs that are connected to respective ones of the radiating elements 130 through respective duplexers 140 and an output that is connected to one of the output ports 110. The output port 110 may be connected to the receive port of a radio (not shown). The receive phase shifters 150 may effect a phase taper to the RF signals that are received at the five radiating elements 130 of the linear array 120 and may then combine those RF signals into a composite received RF signal. Typically, a linear phase taper may be applied to the radiating elements 130 as is discussed above with respect to the transmit phase shifters 150.

The duplexers 140 may be used to couple each radiating element 130 to both a transmit phase shifter 150 and to a receive phase shifter 150. As is well known to those of skill in the art, a duplexer is a three port device that (1) passes signals in a first frequency band (e.g., the transmit band) through a first port while not passing signals in a second band (e.g., a receive band), (2) passes signals in the second frequency band while not passing signals in the first frequency band through a second port thereof and (3) passes signals in both the first and second frequency bands through the third port thereof, which is often referred to as the "common" port.

As can be seen from FIG. 2, the base station antenna 100 may include a total of twelve phase shifters 150. While the two transmit phase shifters 150 for each linear array 120 (i.e., one transmit phase shifter 150 for each polarization) may not need to be controlled independently (and the same is true with respect to the two receive phase shifters 150 for each linear array 120), there still are six sets of two phase shifters 150 that should be independently controllable.

Each phase shifter 150 shown in FIG. 2 may be implemented, for example, as a rotating wiper phase shifter. The phase shifts imparted by a phase shifter 150 to each sub-component of an RF signal may be controlled by a mechanical positioning system that physically changes the position of the rotating wiper of each phase shifter 150, as will be explained with reference to FIG. 3.

Figure 3:
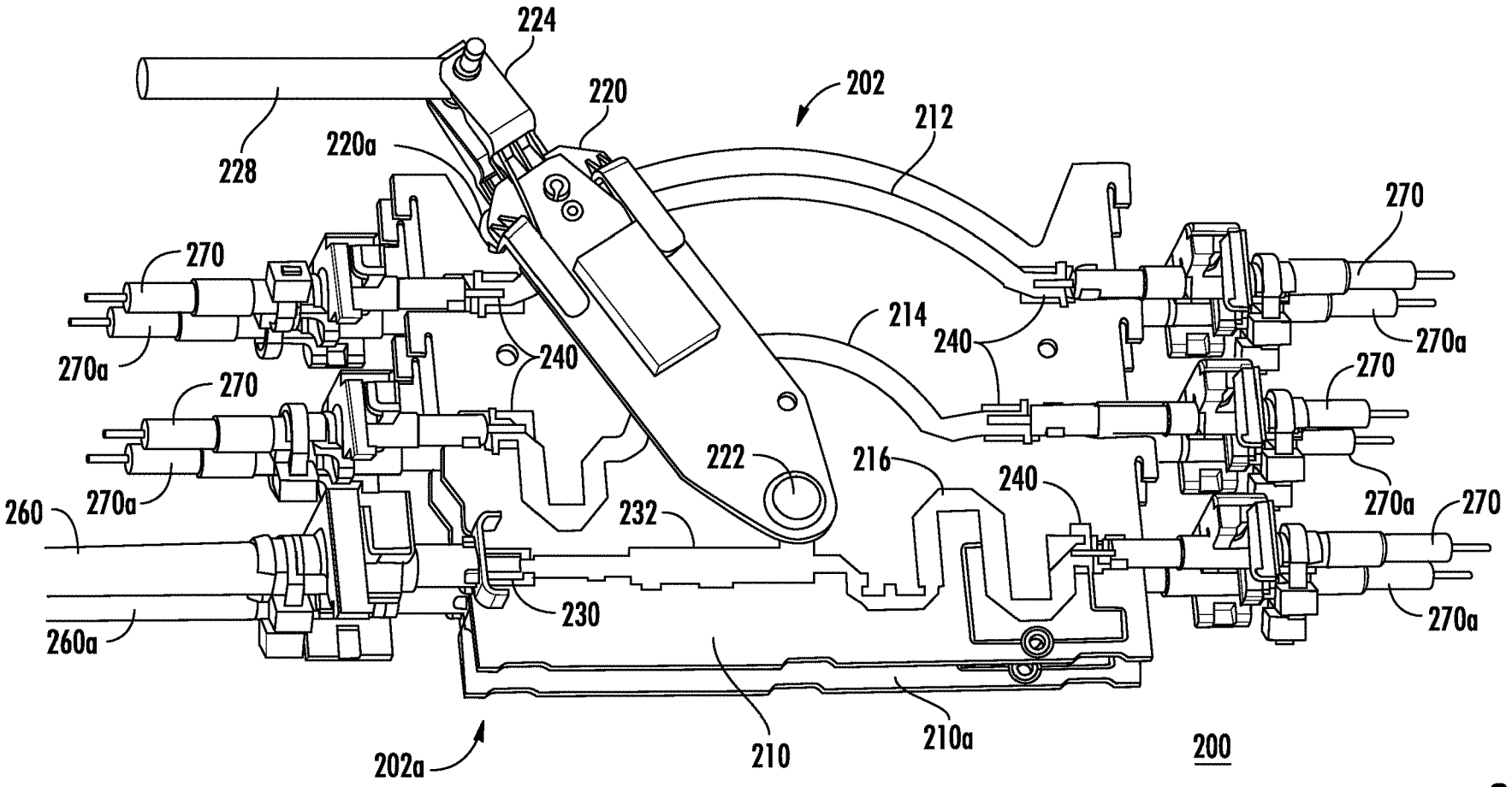
FIG. 3 is a front perspective view of a pair of electromechanical phase shifters that may be included in the base station antenna of FIGS. 1A-2.

Referring to FIG. 3, a dual rotating wiper phase shifter assembly 200 is illustrated that may be used to implement, for example, two of the phase shifters 150 of FIG. 2 (one for each of the two polarizations). The dual rotating wiper phase shifter assembly 200 includes first and second phase shifters 202, 202*a*. In the description of FIG. 3 that follows it is assumed that the two phase shifters 202, 202*a* are each transmit phase shifters that have one input and five outputs. It will be appreciated that if the phase shifters 202, 202*a* are instead used as receive phase shifters then the terminology changes, because when used as receive phase shifters there will be five inputs and a single output.

As shown in FIG. 3, the dual phase shifter 200 includes first and second main (stationary) printed circuit boards 210, 210*a* that are arranged back-to-back as well as first and second rotatable wiper printed circuit boards 220, 220*a* (wiper printed circuit board 220*a* is barely visible in the view of FIG. 3) that are rotatably mounted on the respective main printed circuit boards 210, 210*a*. The wiper printed circuit boards 220, 220*a* may be pivotally mounted on the respective main printed circuit boards 210, 210*a* via a pivot pin 222. The wiper printed circuit boards 220, 220*a* may be joined together at their distal ends via a bracket 224.

The position of each rotatable wiper printed circuit boards 220, 220*a* above its respective main printed circuit board 210, 210*a* is controlled by the position of a mechanical linkage 170 (with a RET rod 172 partially shown in FIG. 3) that extends between an output member of a RET actuator and the phase shifter 200.

Each main printed circuit board 210, 210*a* includes transmission line traces 212, 214. The transmission line traces 212, 214 are generally arcuate. In some cases the arcuate transmission line traces 212, 214 may be disposed in a serpentine pattern to achieve a longer effective length. In the example illustrated in FIG. 3, there are two arcuate transmission line traces 212, 214 per main printed circuit board 210, 210*a* (the traces on printed circuit board 210*a* are not visible in FIG. 3), with the first arcuate transmission line trace 212 being disposed along an outer circumference of each printed circuit board 210, 210*a*, and the second arcuate transmission line trace 214 being disposed on a shorter radius concentrically within the outer transmission line trace 212. A third transmission line trace 216 on each main printed circuit board 210, 210*a* connects an input pad 230 on each main printed circuit board 210, 210*a* to an output pad 240 that is not subjected to an adjustable phase shift.

The main printed circuit board 210 includes an input trace 232 leading from the input pad 230 near an edge of the main printed circuit board 210 to the position where the pivot pin 222 is located. RF signals on the input trace 232 are coupled to a transmission line trace (not visible in FIG. 3) on the wiper printed circuit board 220, typically via a capacitive connection. The transmission line trace on the wiper printed circuit board 220 may split into two secondary transmission line traces (not shown). The RF signals are capacitively coupled from the secondary transmission line traces on the wiper printed circuit board 220 to the transmission line traces 212, 214 on the main printed circuit board. Each end of each transmission line trace 212, 214 may be coupled to a respective output pad 240. A coaxial cable 260 or other RF transmission line component may be connected to input pad 230. A respective coaxial cable 270 or other RF transmission line component may be connected to each respective output pad 240. As the wiper printed circuit board 220 moves, an electrical path length from the input pad 230 of phase shifter 202 to each radiating element 130 served by the transmission lines 212, 214 changes. For example, as the wiper printed circuit board 220 moves to the left it shortens the electrical length of the path from the input pad 230 to the output pad 240 connected to the left side of transmission line trace 212 (which connects to a first radiating element 130), while the electrical length from the input pad 230 to the output pad 240 connected to the right side of transmission line trace 212 (which connects to a second radiating element) increases by a corresponding amount. These changes in path lengths result in phase shifts to the signals received at the output pads 240 connected to transmission line trace 212 relative to, for example, the output pad 240 connected to transmission line trace 216. The second phase shifter 202*a* may be identical to the first phase shifter 202.

The RET actuators that are used to physically adjust the settings of the phase shifters 150 are typically spaced apart from the phase shifters 150. Referring to FIG. 3, mechanical linkages 170 are used to transfer the motion of a RET actuator to a moveable element of a phase shifter. Each RET actuator may be controlled to generate a desired amount of movement of an output member thereof. The movement may comprise, for example, linear movement or rotational movement. A mechanical linkage 170 is used to translate the movement of the output member of the RET actuator to movement of a moveable element of a phase shifter 200 (e.g., a wiper arm, a sliding dielectric member, etc.). The mechanical linkage 170 may comprise, for example, one or more plastic or fiberglass RET rods 172 that extend between the output member of the RET actuator and the moveable element of the phase shifter. As shown in FIG. 3, the rotating wiper printed circuit board 220*a* of phase shifter 202*a* may be controlled by the same mechanical linkage 170 as the rotating wiper printed circuit board 220 of phase shifter 202. For example, if a linear array 120 includes dual polarized radiating elements 130, typically the same phase shift will be applied to the RF signals transmitted at each of the two orthogonal polarizations. In this case, a single mechanical linkage 170 may be used to control the positions of the wiper printed circuit boards 220, 220*a* on both phase shifters 202, 202*a*.

Figure 4:
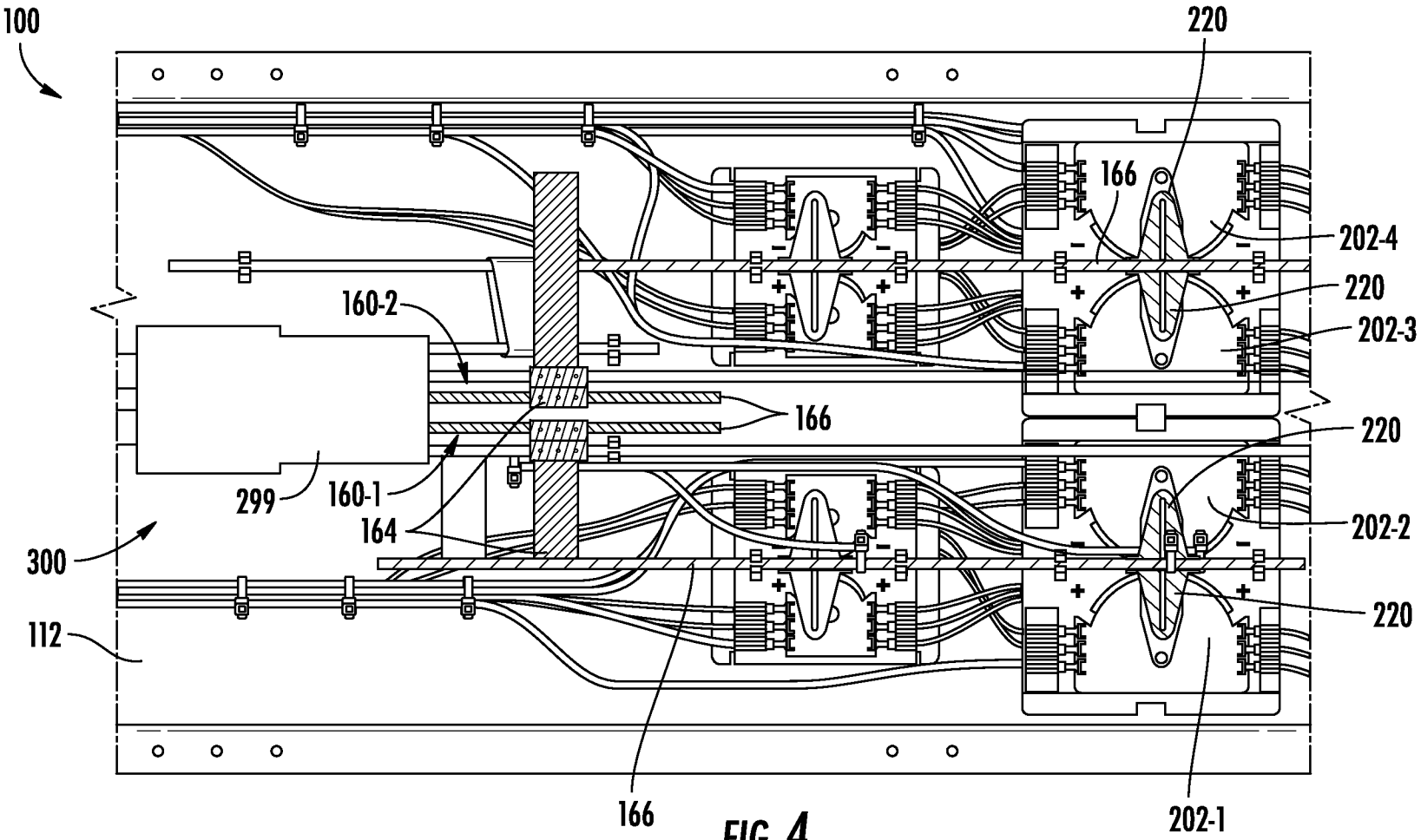
FIG. 4 is a rear view of a portion of the RET base station antenna of FIGS. 1A-2 that shows one embodiment of how mechanical linkages are used to connect the output members of the RET actuator to respective ones of the phase shifters illustrated in FIG. 3.

FIG. 4 is a rear view of a portion of the base station antenna 100 that shows how mechanical linkages 160-1 and 160-2 are used to connect the output members of the RET actuator 300 to moveable elements 220, 220*a* of respective pairs of phase shifters 202-1 through 202-4. The mechanical linkages 160-1 and 160-2 are shaded in FIG. 4 to better show the connection of the mechanical linkages 160-1 to the phase shifters 202-1 and 202-2 and the connection of mechanical linkage 160-2 from the RET actuator 300 to the phase shifters 202-3 and 202-4. The RET actuator 300 is mounted in the antenna 100 behind the backplane 112. Multiple pairs of phase shifters may be mounted rearwardly of the backplane 112 (only four pairs of phase shifters are visible in FIG. 4). Since the base station antenna 100 has linear arrays 120, 130 that are formed of dual-polarized radiating elements 122, 132, the phase shifters 202 are mounted in pairs since the phase shifter 202 for each polarization will be adjusted the same amount. The RET actuator 300 is connected to the phase shifters 202-1 to 202-4 by mechanical linkages 160-1 and 160-2. The mechanical linkages 160-1 and 160-2 are provided to connect each output member of the RET actuator 300 to a respective pair of phase shifters 202. Each mechanical linkage 160-1, 160-2 may comprise a plurality of RET rods 166 connected by linkages 164. The RET rods 166 may comprise, for example, generally rigid fiberglass or plastic longitudinally-extending rods. The RET rods 166 typically extend in a longitudinal direction of the antenna 100, while the RET linkages 164 typically extend along the width and/or depth axes to connect two RET rods 166 together, and/or to connect a RET rod 166 to an output member of the RET actuator or to a moveable element of a phase shifter assembly. Each mechanical linkage 160-1, 160-2 is used to transfer a linear movement of the output member of the RET actuator 300 to a wiper board 220 of a phase shifter, although in other embodiments rotational movement may be transferred by the mechanical linkage. In some embodiments, a single RET rod may comprise the mechanical linkages 160-1, 160-2 while in other embodiments, a greater number of RET rods and linkages may be used. Other mechanical linkages shown in FIG. 4 may include similar combinations of RET rods 166 and RET linkages 164 which may be operatively coupled between additional RET actuators 300 and phase shifters.

Figure 5:
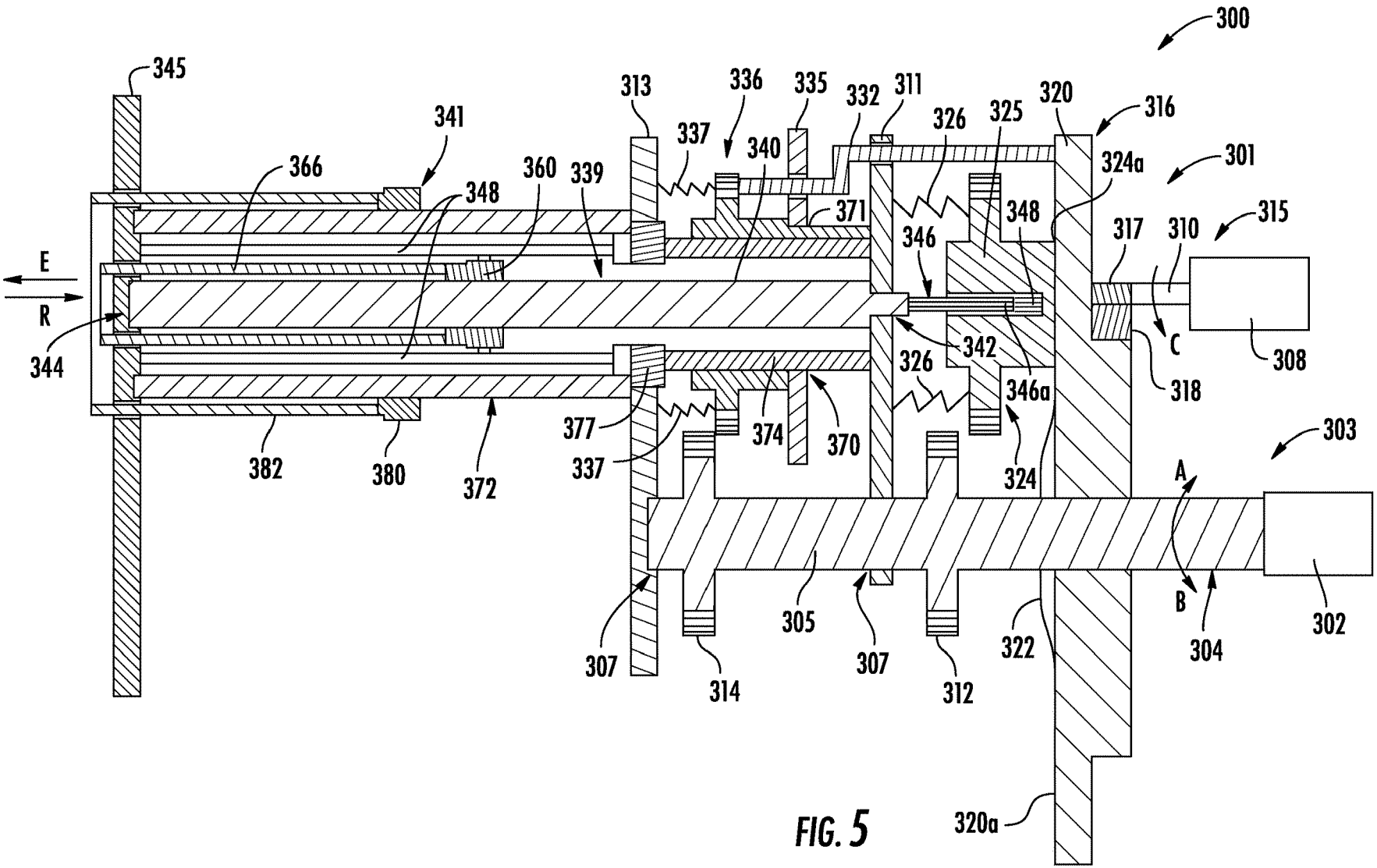
FIG. 5 is a schematic partial section view of an embodiment of a RET actuator according to embodiments of the invention.
Figure 6:
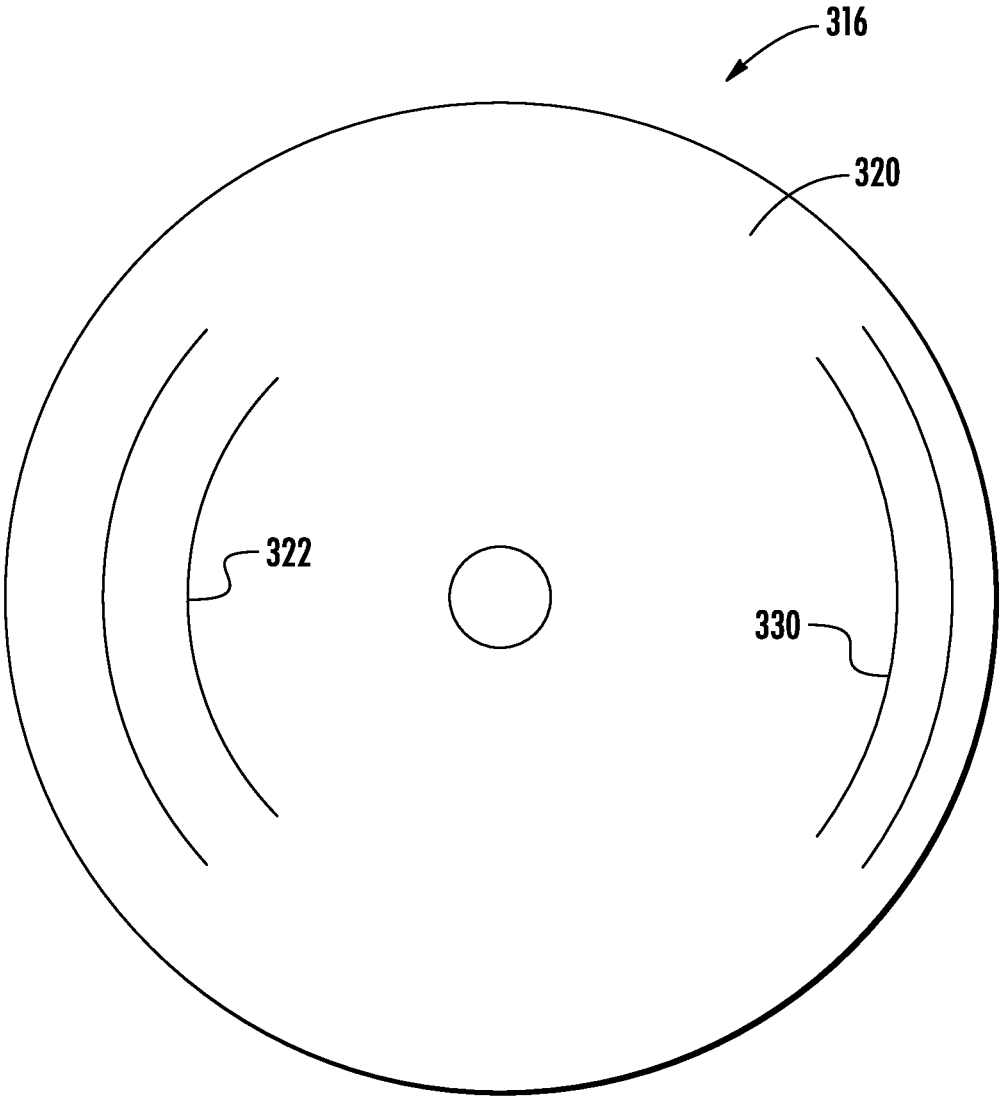
FIG. 6 is a front view of an index gear used in the embodiment of the RET actuator of FIG. 5.
Figure 7:
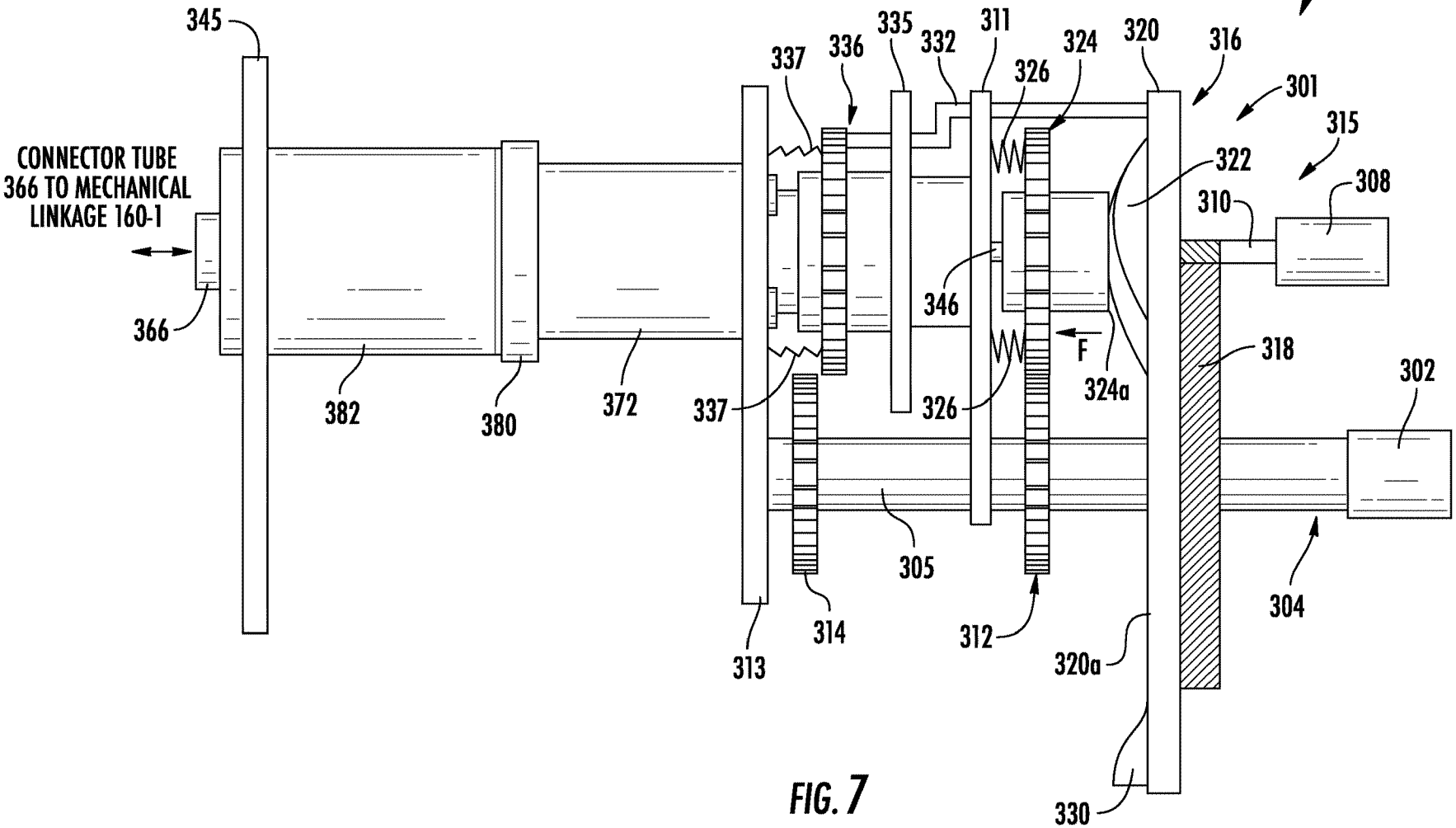
FIG. 7 is a view of the RET actuator of FIG. 5 with a first drive system engaged.
Figure 8:
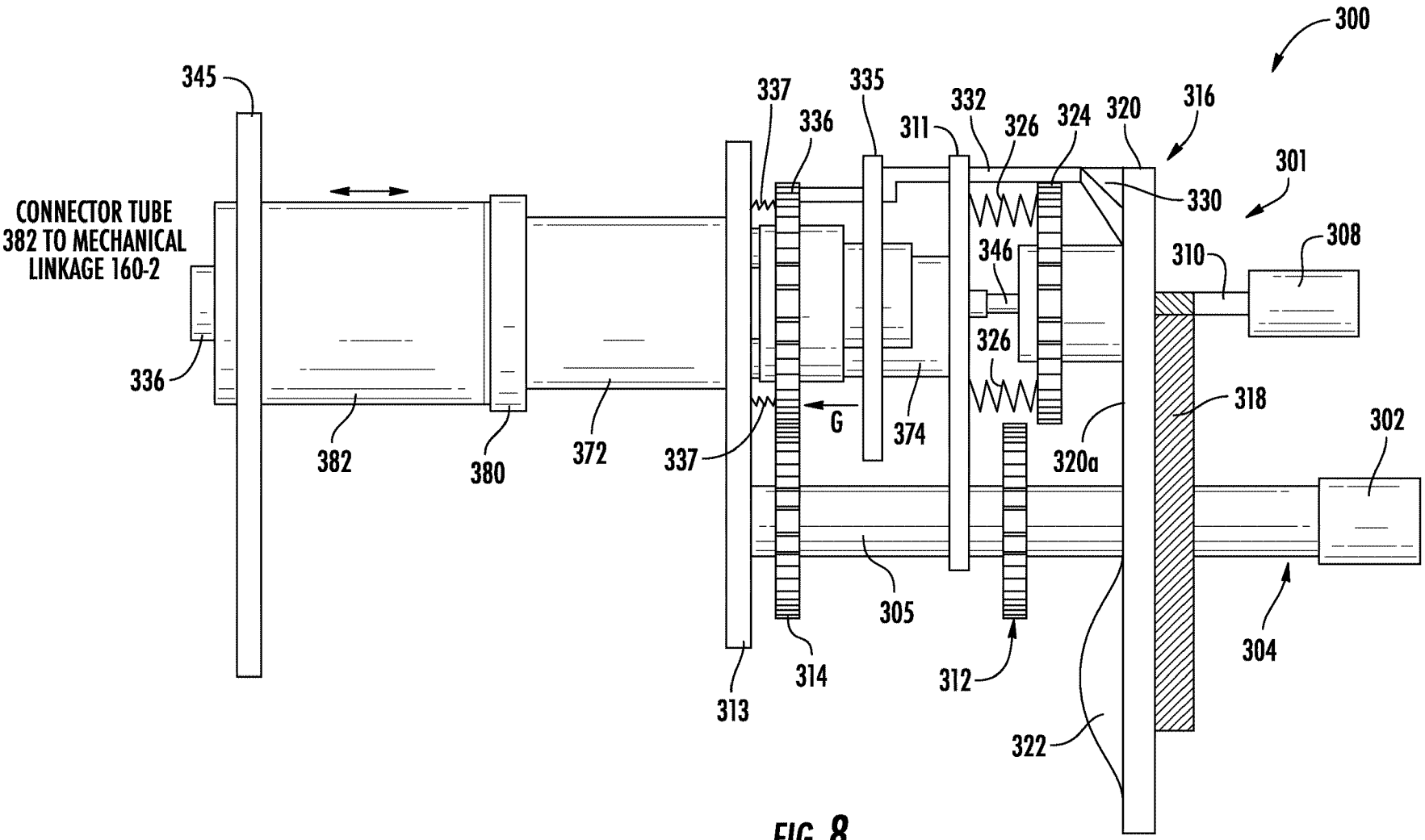
FIG. 8 is a view of the RET actuator of FIG. 5 with a second drive system engaged.

RET actuator 300 according to embodiments of the present invention is shown in FIGS. 5 through 8. The elements of the RET actuator 300 may be mounted in and supported by a housing 299 (FIG. 4). Only the portions of the housing 299 necessary for understanding the invention are shown in FIGS. 5, 7 and 8, as will hereinafter be described. Referring to FIG. 5, the RET actuator 300 comprises a first rotary drive element 303 comprising a reversible drive motor 302 such as a reversible electric motor having a rotary output 304. The drive motor 302 and rotary output 304 may be rotated in either direction as represented by arrows A and B in FIG. 5. Output 304 from drive motor 302 is coupled to a drive gear 312 and a drive gear 314 such that the drive gears 312 and 314 may be rotated in either of directions A and B. The output 304 may comprise an elongated shaft 305, as shown, with the drive gears 312 and 314 mounted directly on the shaft 305 in spaced relationship such that the shaft 305 and drive gears 312, 314 rotate together. The shaft 305 may be supported in suitable bearing structures 307 such as cylindrical bearings formed in internal walls 311, 313 of the RET actuator housing 299. Alternatively, a transmission such as a gear train, belt drive, chain drive or the like may connect the rotary output 304 to the shaft 305 that supports the drive gears 312 and 314, rather than using the direct mounting arrangement shown in FIG. 5.

The RET actuator 300 comprises an index system 301. The index system 301 comprises a second drive element 315. In one embodiment the second drive element 315 is a rotary drive element comprising an index motor 308 such as an electric motor having a rotary output 310 that may be rotated in the direction of arrow C as shown in FIG. 5. Output 310 from index motor 308 is operatively coupled to index gear 316 such that index gear 316 may be rotated by index motor 308. While a one-direction index motor 308 is shown, index motor 308 may be a two-direction motor such that the index gear 316 may be rotated in two directions. The output 310 may include a worm gear 317 that engages a mating gear 318 of the index gear 316 such that actuation of the motor 308 rotates the index gear 316. The index gear 316 further includes a cam surface 320*a* that is mounted for rotation with the mating gear 318 such that actuation of motor 308 rotates the cam surface 320*a* with mating gear 318. The index gear 316 may be mounted for rotation on the output 304 such that the output 304 forms the axis of rotation of index gear 316. Alternatively, the index gear 316 may be mounted on a separate shaft. Because the index gear 316 is rotated, the body 320 and the cam surface 320*a* may be considered a cam wheel.

The cam surface 320*a* includes a first cam profile 322 and a second cam profile 330 as shown in FIG. 6. The first cam profile 322 is radially aligned with and contacts the back side 324*a* of driven gear 324. The driven gear 324 is biased into engagement with the cam surface 320*a* and the cam profile 322 by a spring or springs 326 such that contact is maintained between the back side 324*a* of the driven gear 324 and the cam surface 320*a*. The cam profile 322 forms a ramp that extends from the cam surface 320*a* and is shaped such that as the cam wheel 320 rotates, the cam profile 322 will selectively force the driven gear 324 against the bias force of the springs 326 to move the driven gear 324 to the left, as viewed in FIG. 5, to an engaged position as shown in FIG. 7. The cam profile 322 is also shaped to selectively release pressure against the driven gear 324 to allow the bias force exerted by the springs 326 to return the driven gear 324 to the right to the disengaged position shown in FIG. 5.

While in the illustrated embodiment, the index system 301 comprise a rotary drive element 315 and the cam surface 320*a* is a surface of a rotating cam wheel, the index system may comprise a linear drive element and the cam surface 320*a* may be a surface of a linearly movable cam plate having the two cam profiles 322 and 330 formed thereon.

The rotating gears 317 and 318 may be replaced by a rack and pinion or other linear drive. The cam surface in such an embodiment may be moved linearly to selectively engage the two cam profiles 322 and 330 with the driven gears 324 and 336.

The second cam profile 330 is radially aligned with and is positioned to contact one end of linkage 332. The opposite end of linkage 332 engages one side of a driven gear 336. The driven gear 336 is biased into engagement with the linkage 332 and the linkage 332 is biased into engagement with the cam surface 320*a* of cam wheel 320 by a spring or springs 337 such that contact is maintained between the driven gear 336, linkage 332 and the cam surface 320*a* of cam wheel 320. The cam profile 330 forms a ramp that extends from the cam surface 320*a* of the cam wheel 320 and is shaped such that as the cam wheel 320 rotates, the cam profile 330 selectively forces the linkage 332 and driven gear 336 against the bias force of the springs 337 to move the driven gear 336 to the left, as viewed in FIG. 5, to an engaged position as shown in FIG. 8. The cam profile 330 is also shaped to selectively release pressure against the linkage 332 and driven gear 336 to allow the bias force exerted by the springs 337 to return the driven gear 336 to the right, to the disengaged position shown in FIG. 5. The linkage 332 may comprise additional elements in addition to the single link shown in the FIG. 5 and may have any shape provided force of the cam profile 330 is transmitted to the driven gear 336. Moreover, a linkage may also be used to transmit the force of the first cam profile 322 to the driven gear 324 rather than using the direct contact shown in FIG. 5.

The driven gear 324 is positioned such that when it is moved to the engaged position by the first cam profile 322, the driven gear 324 operatively engages the drive gear 312. The driven gear 336 is positioned such that when it is moved to the engaged position by the second cam profile 330, the driven gear 336 operatively engages the drive gear 314. The first and second profiles 322, 330 are arranged out of phase with one another, as shown in FIG. 6, such that when the first driven gear 324 is engaged with the first drive gear 312, the second driven gear 336 is disengaged from the second drive gear 314 and when the first driven gear 324 is disengaged from the first drive gear 312, the second driven gear 336 is engaged with the second drive gear 314. The profiles 322, 330 are also arranged such that both driven gears 324 and 336 may be disengaged from both drive gears 312, 314 simultaneously as shown in FIG. 5. The index gear 316 is rotated by index motor 308 to select which of the driven gears 324, 336 is operatively coupled to the drive motor 302.

The driven gear 324 is coupled to a linear drive 339. The driven gear 324 may be mounted on one end of the linear drive 339. The linear drive 339 may comprise a rotary drive member such as an inner lead screw 340 where the lead screw 340 and driven gear 324 are rotatable together about a common axis of rotation. The inner lead screw 340 is supported on bearing surfaces 342, 344 such that the lead screw 340 can rotate about its longitudinal axis. The bearing surfaces 342, 344 may comprise cylindrical bearings formed on the inner walls 311 and 345 of the RET actuator housing, or other similar structures, for rotatably supporting the lead screw 340. A stub 346 extends from the end of the lead screw 340 that is received in an aperture 348 formed in the barrel 325 of the driven gear 324. A sliding connector connects the stub 346 to the driven gear 324 such that the driven gear 324 may reciprocate along stub 346 but is constrained to rotate with the stub 346 and lead screw 340. The sliding connector may comprise longitudinally extending splines 346*a* on the stub 346 that mate with a mating engagement structure in the aperture 348 such that the driven gear 324 may slide along the stub 346 but is otherwise constrained to rotate with the stub 346. Other structures may be used to provide the sliding connector between the stub 346 and aperture 348 such as a keyed connection, a pin and slot connection or the like.

A follower 360, such as a nut, is threadably mounted on the lead screw 340 such that rotation of the lead screw 340 causes the linear translation of the follower 360 along the length of the lead screw 340. The follower 360 may slide along a frame rail 348 such that the follower is prevented from rotating with the lead screw 340 and is guided for movement in a linear reciprocating manner. Rotation of the lead screw 340 in a first direction causes the follower 346 to move in an extension direction E (to the left as viewed in FIG. 5) and rotation of the lead screw 340 in a second direction causes the follower 346 to move in a retraction direction R (to the right as viewed in FIG. 5). While a specific linear drive is described, the linear drive may comprise other suitable mechanisms such as a ball screw, a roller screw or the like.

A connector tube 366 is mounted to the follower 360 such that the connector tube 366 moves in a linear reciprocating manner with the follower 360. The connector tube 366 is connected to a mechanical linkage of the RET system such as mechanical linkage 160-1 such that movement of the connector tube 366 results in the corresponding movement of the mechanical linkage 160-1 and a corresponding adjustment of the phase shifter connected to that mechanical linkage. The connector tube 366 may be directly coupled to a RET rod or other linkage to transfer movement of the connector rod 366 to the mechanical linkage 160-1.

The driven gear 336 is coupled to a linear drive 341. The driven gear 324 may be mounted on one end of linear drive 341. The linear drive 341 may comprise a rotary drive member such as an outer lead screw 372 where the lead screw 372 and driven gear 336 are rotatable together about a common axis of rotation. The driven gear 336 comprises a cylindrical barrel 371 that is mounted for rotation on a cylindrical bearing surface 370 such that the driven gear 336 is rotatable about its longitudinal axis. The bearing surface 370 may comprise an inner wall 335 of the RET actuator housing 299 formed with a cylindrical bearing surface, or other similar structure, for rotatably supporting the driven gear 336. The driven gear 336 is operatively coupled to an outer lead screw 372 such that rotation of the driven gear 336 results in rotation of the outer lead screw 372. In the illustrated embodiment, the driven gear 336 comprises a tubular barrel 371 that is mounted on a tubular extension 374 of lead screw 372. The lead screw 372 and extension 374 are coupled by bearing 377 such that rotation of the extension 374 results in the rotation of the lead screw 372. A sliding connector connects extension 374 to the driven gear 336 such that the driven gear 336 may reciprocate along extension 374 but is constrained to rotate with the extension 374 and lead screw 340. The sliding connector may comprise longitudinally extending splines on the exterior of extension 374 that mate with a mating engagement structure in barrel 371 of driven gear 336 such that the driven gear 336 may slide along the extension 374 but is otherwise constrained to rotate with the extension 374. Other structures may be used to provide the sliding connector between the extension 374 and driven gear 336 such as a keyed connection, a pin and slot connection or the like.

A follower 380, such as a nut, is threadably mounted on the lead screw 372 such that rotation of the lead screw 372 results in the linear translation of the follower 380 along the length of the lead screw 372. A connector tube 382 is mounted to the follower 360 such that the connector tube 382 moves in a linear reciprocating manner with the follower 380. The follower 380 is prevented from rotating with the lead screw 372 such that rotation of the lead screw 372 moves the follower 380 in a linear reciprocating manner. For example, the follower 380 may slide along a frame rail (not shown) similar to frame rail 348 or the connector tube 382 may non-rotatably engage the wall 345. Rotation of the lead screw 372 in a first direction causes the follower 380 to move in the extension direction E (to the left as viewed in FIG. 5) and rotation of the lead screw 372 in a second direction causes the follower 380 to move in the retraction direction R (to the right as viewed in FIG. 5). While a specific linear drive is described the linear drive may comprise other suitable mechanisms such as a ball screw, roller screw or the like.

The follower 380 is connected to a mechanical linkage of the RET system such as mechanical linkage 160-2 by connector tube 382 such that movement of the connector tube 382 results in the corresponding movement of the mechanical linkage 160-2 and a corresponding adjustment of the phase shifter connected to that mechanical linkage. The follower 380 may be directly coupled to a RET rod or other linkage to transfer movement of the follower 380 to the mechanical linkage 160-2.

In the RET actuator 300, the driven gears 324 and 336 are coaxial where the axes of rotation of the driven gears 324 and 336 are coaxial. The lead screws 340 and 372 are also coaxial where that the axes of rotation of the lead screws 340 and 372 are coaxial. Moreover, the axes of rotation of the driven gears 324 and 336 and the lead screws 340 and 372 are coaxial. The lead screw 340, follower 360 and connector tube 366 are located inside of the lead screw 372. This arrangement of components provides a compact RET actuator. The drive gears 312 and 314 are coaxial where that the axes of rotation of the drive gears 312 and 314 are coaxial. The axis of rotation of the index gear 316 may also be coaxial with the axes of rotation of the drive gears 312 and 314.

The operation of the RET actuator 300 will now be described with reference to FIGS. 5 through 8. The RET actuator 300 may be used to actuate either one of two mechanical linkages 160-1 and 160-2. The first drive system comprising drive gear 312, driven gear 324, lead screw 340, follower 360 and connector tube 366 is connected to the first mechanical linkage 160-1. The second drive system comprising drive gear 314, driven gear 336, lead screw 372, follower 380 and connector tube 382 is connected to the second mechanical linkage 160-2. The system is shown in FIG. 5 in a neutral position where neither the first drive system nor the second drive system is operatively coupled to rotary drive element 303.

Referring to FIG. 7, to adjust the first mechanical linkage 160-1 and its associated phase shifter, the index motor 308 is actuated to rotate index gear 316. Specifically, the output 310 of motor 308 drives gear 318 to rotate cam wheel 320. As cam wheel 320 rotates, the cam profile 322 moves driven gear 324 along stub 346 in the direction of arrow F. The profile of cam profile 322 moves driven gear 324 to the left as viewed in FIG. 5, against the bias of spring 326, until driven gear 324 engages drive gear 312. It should be noted that the cam surface 320*a* of cam wheel 320 also contacts linkage 332 as the cam wheel 320 rotates. However, the cam profiles 322 and 330 are out of phase with one another. As a result, when driven gear 324 is moved into engagement with drive gear 312, driven gear 336 remains in the disengaged position.

When driven gear 324 is moved into engagement with the drive gear 312, the index motor 308 is deactivated and rotation of the index gear 316 is stopped. The cam profile 322 holds the driven gear 324 in engagement with the drive gear 312. To adjust the position of the mechanical linkage 160-1 associated with the first drive system, the drive motor 302 is then actuated. Motor 302 may be rotated in either direction such that the lead screw 340 may be rotated in either direction along its longitudinal axis. As the lead screw 340 rotates, the follower 360 is moved in a linear manner up or down the length of the lead screw 340 to extend or retract the connector tube 366. As the connector tube 366 is extended and/or retracted the mechanical linkage 160-1 connected to the connector tube 366 is also extended and/or retracted to adjust the phase shifter associated with the first mechanical linkage 160-1. After the mechanical linkage 160-1 and associated phase shifter are properly adjusted, the motor 302 is deactivated to fix the position of the phase shifter. The index motor 308 may then be activated to rotate the cam wheel 320 and move the RET actuator to the neutral position shown in FIG. 5.

Referring to FIG. 8, to adjust the second mechanical linkage 160-2 and its associated phase shifter, the index motor 308 is actuated to rotate index gear 316. The output 310 of motor 308 drives gear 318 to rotate cam wheel 320. As cam wheel 320 rotates, the cam profile 330 moves driven gear 336 along extension 374 via linkage 332. Specifically, cam profile 330 engages linkage 332 to move the linkage 332, and linkage 332 moves driven gear 336, to the left as viewed in FIG. 8 in the direction of arrow G, against the bias of spring 337, until driven gear 336 engages drive gear 314. As previously explained, the cam surface 320*a* of the cam wheel 320 also contacts driven gear 324 as the cam wheel 320 rotates. However, the cam profiles 322 and 330 are out of phase with one another. As a result, when driven gear 336 is moved into engagement with drive gear 314, driven gear 324 remains in the disengaged position.

When driven gear 336 is moved into engagement with the drive gear 314, the index motor 308 is deactivated and rotation of the index gear 316 is stopped. The cam profile 330 holds the driven gear 336 in engagement with the drive gear 314. To adjust the position of the phase shifter associated with the second linkage system 160-2, the drive motor 302 is then actuated. Drive motor 302 may be rotated in either direction such that the lead screw 372 may be rotated in either direction along its longitudinal axis. As the lead screw 372 rotates, the follower 380 is moved in a linear manner up or down the length of the lead screw 372 to extend or retract the mechanical linkage 160-2 connected to the follower 380 via connector tube 382 to adjust the phase shifter associated with the second mechanical linkage 160-2. After the mechanical linkage 160-2 and associated phase shifter are properly adjusted, the drive motor 302 is deactivated to fix the position of the phase shifter. The index motor 308 may then be activated to rotate the cam wheel 320 and move RET actuator to the neutral position shown in FIG. 5.

The RET actuators according to embodiments of the present invention have various advantages over conventional RET actuators. The RET actuators may be very compact, and may have a low profile which allows them to readily be installed in a wide variety of different base station antennas.

The RET actuators according to embodiments of the present invention are suitable for use in base station antennas. The base station antennas may include any number of arrays of radiating elements (which can, but do not have to be, linear arrays of radiating elements), and the RET actuators may be used to control phase shifters that are associated with the arrays of radiating elements.

The present invention has been described above with reference to the accompanying drawings. The invention is not limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Herein, the terms "attached", "connected", "interconnected", "contacting", "mounted" and the like can mean either direct or indirect attachment or contact between elements, unless stated otherwise.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Components of the various embodiments of the present invention discussed above may be combined to provide additional embodiments. Thus, it will be appreciated that while a component or element may be discussed with reference to one embodiment by way of example above, that component or element may be added to any of the other embodiments.

The invention claimed is:

1. A base station antenna, comprising:

a remote electronic tilt ("RET") actuator;

a first mechanical linkage connected between the RET actuator and a first phase shifter, and a second mechanical linkage connected between the RET actuator and a second phase shifter, wherein the RET actuator comprises:

a rotary drive element operably coupled to at least one drive gear for moving the at least one drive gear in a first rotary direction and a second rotary direction;

a first drive system connected to the first mechanical linkage, the first drive system comprising a first driven gear;

a second drive system connected to the second mechanical linkage, the second drive system comprising a second driven gear, wherein the first driven gear and the second driven gear are coaxially located relative to one another; and an index system for selectively coupling the at least one drive gear to one of the first driven gear and the second driven gear.

2. The base station antenna according to claim 1, wherein the rotary drive element comprises a motor having a rotary output.

3. The base station antenna according to claim 1, wherein the at least one drive gear comprises a first drive gear and a second drive gear, and wherein the index system selectively couples the first drive gear to the first driven gear and the second drive gear to the second driven gear.

4. The base station antenna according to claim 1, wherein the at least one drive gear is mounted on an output shaft of the rotary drive element.

5. The base station antenna according to claim 3, wherein the first drive gear and the second drive gear are mounted on an output shaft of the rotary drive element.

6. The base station antenna according to claim 1, wherein the index system comprises a second drive element, wherein the second drive element moves an index gear, and wherein the index gear comprises a cam surface.

7. The base station antenna according to claim 6, wherein the second drive element moves the cam surface.

8. The base station antenna according to claim 6, wherein the index gear rotates, and wherein the index gear comprises a gear that engages a mating gear of the second drive element such that actuation of the second drive element rotates the index gear.

9. The base station antenna according to claim 6, wherein the index system comprises a cam wheel rotated by the second drive element, and wherein the second drive element is rotary.

10. The base station antenna according to claim 6, wherein the cam surface comprises a first cam profile and a second cam profile that is different than the first cam profile, wherein the first cam profile is positioned to contact the first driven gear, and wherein the first driven gear is biased into engagement with the first cam profile by a spring.

11. The base station antenna according to claim 10, wherein the first cam profile is configured to move the first driven gear to an engaged position with the first drive gear.

12. The base station antenna according to claim 11, wherein the second cam profile is configured to move the second driven gear to an engaged position with the second drive gear.

13. The base station antenna according to claim 10, wherein a linkage operatively connects the second cam profile to the second driven gear.

14. The base station antenna according to claim 10, wherein the first cam profile is out of phase with the second cam profile, wherein the first cam profile and the second cam profile are configured such that when the first driven gear is engaged with the first drive gear, the second driven gear is disengaged from the second drive gear and when the first driven gear is disengaged from the first drive gear, the second driven gear is engaged with the second drive gear.

15. The base station antenna according to claim 14, wherein the first cam profile and the second cam profile are configured such that both the first driven gear and the second driven gear may be disengaged from the first drive gear and the second drive gear simultaneously.

16. The base station antenna according claim 3, wherein the first driven gear is operatively coupled to a first linear drive and the second driven gear is operatively coupled to a second linear drive.

17. The base station antenna according to claim 16, wherein the first linear drive and the second linear drive each comprise a respective rotary drive member, wherein the first linear drive comprises a first lead screw, and wherein the second linear drive comprises a second lead screw.

18. The base station antenna according to claim 17, wherein the first lead screw has a first axis of rotation and the second lead screw has a second axis of rotation, the first axis of rotation and the second axis of rotation being coaxial.

19. The base station antenna according to claim 18, wherein the first lead screw is positioned inside of the second lead screw, wherein the first driven gear is mounted for translational motion relative to the first lead screw along the first axis of rotation, wherein a stub is connected to the first lead screw that is slidably received in an aperture formed in the first driven gear, and wherein a sliding connector connects the stub to the first driven gear.

20. The base station antenna according to claim 19, wherein a first follower is threadably mounted on the first lead screw, and wherein a first connector tube connects the first follower to the first mechanical linkage.

21. The base station antenna according to claim 20, wherein the first follower is connected to the first mechanical linkage.

22. The base station antenna according to claim 17, wherein the second driven gear is mounted for translational motion relative to the second lead screw along the second axis of rotation, wherein the second driven gear comprises a tubular barrel that is mounted on a tubular extension of the second lead screw, wherein a sliding connector connects the tubular extension to the second driven gear, wherein a second follower is threadably mounted on the second lead screw, and wherein a second connector tube connects the second follower to the second mechanical linkage.

23. The base station antenna according to claim 22, wherein the second follower is connected to the second mechanical linkage.

24. A method of operating a base station antenna, comprising a remote electronic tilt ("RET") actuator, a first mechanical linkage connected between the RET actuator and a first phase shifter, and a second mechanical linkage connected between the RET actuator and a second phase shifter, the method comprising:

providing a first drive system connected to the first mechanical linkage, the first drive system comprising a first driven gear, and a second drive system connected to the second mechanical linkage, the second drive system comprising a second driven gear, wherein the first driven gear and the second driven gear are coaxially located relative to one another;

coupling a drive gear to a selected one of the first driven gear and the second driven gear; and rotating the drive gear to move the selected one of the first driven gear and the second driven gear in a first rotary direction and a second rotary direction.

25. A remote electronic tilt ("RET") actuator comprising:

a rotary drive element operably coupled to at least one drive gear for moving the at least one drive gear in a first rotary direction and a second rotary direction;

a first drive system connected to the first mechanical linkage, the first drive system comprising a first driven gear;

a second drive system connected to the second mechanical linkage, the second drive system comprising a second driven gear, wherein the first driven gear and the second driven gear are coaxially located relative to one another; and an index system for selectively coupling the at least one drive gear to one of the first driven gear and the second driven gear.

26. A base station antenna, comprising:

a remote electronic tilt ("RET") actuator;

a first mechanical linkage connected between the RET actuator and a first phase shifter, and a second mechanical linkage connected between the RET actuator and a second phase shifter, wherein the RET actuator comprises:

a rotary drive element operably coupled to at least one drive gear for moving the at least one drive gear in a first rotary direction and a second rotary direction;

a first drive system connected to the first mechanical linkage, the first drive system comprising a first driven gear and a first rotary drive member;

a second drive system connected to the second mechanical linkage, the second drive system comprising a second driven gear and a second rotary drive member, wherein the first rotary drive member is located inside the second rotary drive member; and an index system for selectively coupling the at least one drive gear to one of the first driven gear and the second driven gear.

* * * * *